US009080580B2

(12) United States Patent
Heli et al.

(10) Patent No.: US 9,080,580 B2
(45) Date of Patent: Jul. 14, 2015

(54) PROTECTIVE SCREEN ASSEMBLY FOR FANS

(75) Inventors: Thomas Heli, Langenburg (DE); Alfred Korwin, Neuenstein (DE)

(73) Assignee: ebm-pabst Mulfingen GmbH & Co. KG, Mulfingen (DE)

( * ) Notice: Subject to any disclaimer, the term of this patent is extended or adjusted under 35 U.S.C. 154(b) by 992 days.

(21) Appl. No.: 13/177,939

(22) Filed: Jul. 7, 2011

(65) Prior Publication Data

US 2012/0020772 A1 Jan. 26, 2012

(30) Foreign Application Priority Data

Jul. 24, 2010 (DE) ..... 20 2010 010 623 U

(51) Int. Cl.

| | |
|---|---|
| ***F04D 29/62*** | (2006.01) |
| ***F04D 29/70*** | (2006.01) |
| ***F04D 29/64*** | (2006.01) |

(52) U.S. Cl.

CPC ..... *F04D 29/703* (2013.01); *F04D 29/626* (2013.01); *F04D 29/646* (2013.01)

(58) Field of Classification Search

CPC .... F04D 29/626; F04D 29/646; F04D 29/703
USPC ..... 415/121.2, 213.1, 214.1; 416/247 A, 416/247 R
See application file for complete search history.

(56) References Cited

U.S. PATENT DOCUMENTS

| | | | | |
|---|---|---|---|---|
| 5,879,232 | A | 3/1999 | Luter, II et al. | |
| 5,944,488 | A * | 8/1999 | Matson | 416/247 R |
| 6,045,330 | A | 4/2000 | Williams | |
| 6,296,449 | B1 | 10/2001 | Wang | |
| 6,692,240 | B1 | 2/2004 | Leonhard et al. | |
| 7,530,783 | B1 | 5/2009 | Ediger | |
| 2002/0057968 | A1 * | 5/2002 | Lu et al. | 415/213.1 |
| 2004/0033131 | A1 * | 2/2004 | Susek | 415/121.2 |

FOREIGN PATENT DOCUMENTS

| | | |
|---|---|---|
| DE | 3311660 A1 | 4/1984 |
| DE | 3545680 A1 | 6/1987 |
| DE | 603 16 858 T2 | 7/2008 |

* cited by examiner

*Primary Examiner* — Nathaniel Wiehe
*Assistant Examiner* — Woody A Lee, Jr.
(74) *Attorney, Agent, or Firm* — Brinks Gilson & Lione

(57) ABSTRACT

A protective screen assembly (1) for a fan includes a cover part (2) having an air passage opening (4) and a protective screen (6). In the area of the passage opening (4), the protective screen (6) is connected to the cover part (2) via detent connections (8) distributed over the circumference so as to close the passage opening as protection against contact. Each detent connection (8) includes a detent shoulder (10) in the passage opening (4) and a detent element (12) on the protective screen (6). In the area of each detent element (12) at the outer edge of the protective screen (6), the protective screen (6) is resiliently deformable such that each detent element (12), for engaging and disengaging the detent connection (8), can be moved radially relative to the related detent shoulder (10), regionally deforming the protective screen (6).

11 Claims, 3 Drawing Sheets

PROTECTIVE SCREEN ASSEMBLY FOR FANS

CROSS-REFERENCE TO RELATED APPLICATION

This application claims priority to German Utility Application No. 20 2010 010623.0, filed Jul. 24, 2010.

TECHNICAL FIELD OF THE INVENTION

The present invention relates to a protective screen assembly for a fan, comprising a cover part to be arranged upstream or downstream of a rotating fan wheel, the cover part having an air passage opening, and a protective screen that is connected or can be connected in the area of the passage opening to the cover part via a plurality of detent connections distributed over the circumference so as to close the passage opening as protection against contact, wherein each detent connection is composed of a detent shoulder that is rigidly arranged in the passage and a detent element arranged on the protective screen.

BACKGROUND OF THE INVENTION

The publication DE 20 2008 002 356 U1 describes different embodiments of a compact fan comprising a protective screen assembly of the aforementioned kind. The known compact fan has a front plate with an air passage as the cover part, wherein the passage opening is covered or can be covered with a protective screen as protection against contact with the rotating fan parts. To this end, the protective screen can be snapped to the front plate by means of a clip connection. For this purpose, in a first embodiment, the protective screen has axially projecting detent elements at the outer edge thereof, which can be snapped to detent shoulders of the front plate. The protective screen only engages with the projecting detent elements slightly in the opening area, so that the screen itself clearly projects over the opening plane. The attachment is solely dependent on the resilience of the axially projecting detent elements. As an alternative to this snap-fit embodiment, the protective screen can also be configured integrally with the front plate in another embodiment, and can then also be located approximately in the opening plane.

SUMMARY OF THE INVENTION

The object of the present invention is to improve a protective screen assembly of the described kind such that, without the protective screen projecting, secure and in particular play-free detent attachment of the protective screen in the passage opening of the cover part is ensured. The protective screen should be easy and quick to install and, in particular, to detach as well.

According to the invention, the detent elements are arranged at the outer edge of the protective screen in the screen plane thereof, wherein in the area of each detent element, the protective screen is configured in a resiliently deformable manner such that, for the purpose of engaging and disengaging the detent connection, each detent element can be moved radially relative to the associated detent shoulder with regional elastic deformation of the protective screen. As a result of this, the protective screen can advantageously be inserted axially into the mouth area of the passage opening, wherein the individual detent connections can be snap-fit by manual axial pressure due to the axial insertion movement, wherein each detent element, as a whole and without elastic deformation, moves radially, only deforming the adjacent protective screen area, and subsequently radially latches over the detent shoulders toward the outside in a positively engaging manner. Detaching the detent connections is advantageously possible with a reverse direction of movement by manually applying a radially inwardly acting detaching force to the area of each detent element, by means of which force the detent element can be moved radially inward so as to release the positive detent connection. In this way, the individual detent connections can be successively released until the entire protective screen has been detached.

Important advantages are achieved by this invention, in particular very good and secure mounting as a result of a correspondingly high radial spring force in the area of the individual detent elements, wherein the degree of this spring force can be specified by the material- and shape-dependent deformation properties of the protective screen. As a result of the recessed arrangement of the protective screen in the mouth area of the passage opening, combined with the configuration of the detent connections, flow-optimized properties are additionally achieved, in particular for applications without a protective screen because the passage opening is designed with almost no projecting parts.

In a preferred embodiment of the invention, as viewed in the circumferential direction, between two respective adjacent detent elements, the protective screen has a radial support section with an end-side contact contour for the radial and axial contact with the opening edge of the passage opening of the cover part. In the snapped-in state of the protective screen, the support sections preferably rest axially and radially without play on the opening edge of the passage opening with an elastic contact force. This elastic contact force is likewise generated by a regional elastic deformation of the protective screen in that, when the protective screen is inserted, the support sections make contact first, while the detent elements are snapped to the related detent shoulders only after being further pushed in, elastically deforming the protective screen. Thus, freedom of play is achieved by elastic pre-tension, as a result of which disturbing noises (vibrations) during operation are also avoided.

Further particular characteristics of the embodiments will be explained in more detail in the description.

BRIEF DESCRIPTION OF THE DRAWINGS

The invention will be explained in more detail based on a preferred exemplary embodiment shown in the drawings, which show.

DETAILED DESCRIPTION OF THE INVENTION

Figure 1:
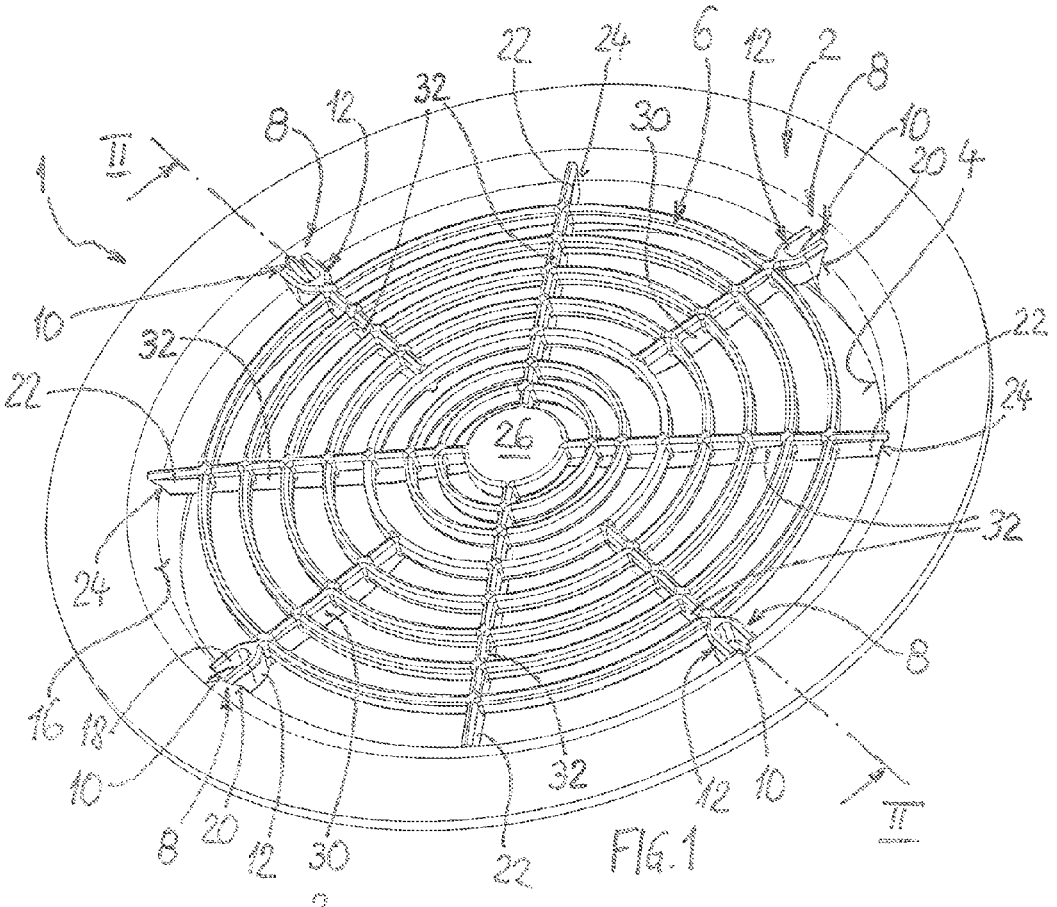
FIG. 1 a perspective view of a protective screen assembly according to the invention in a connected, snapped-in state of the components, FIG. 2 a perspective cutaway view of the intersection II-II in FIG. 1 of the protective screen assembly according to the invention, FIG. 3 an enlarged detail of the area III in FIG. 2, FIG. 4 a top view of only the protective screen, FIG. 5 a diagonal section of the protective screen cut in the plane V-V according to FIG. 4 and FIG. 6 a perspective view of the protective screen according to FIG. 4.

Identical parts are always denoted by the same reference numerals in the different figures of the drawing.

Figure 2:
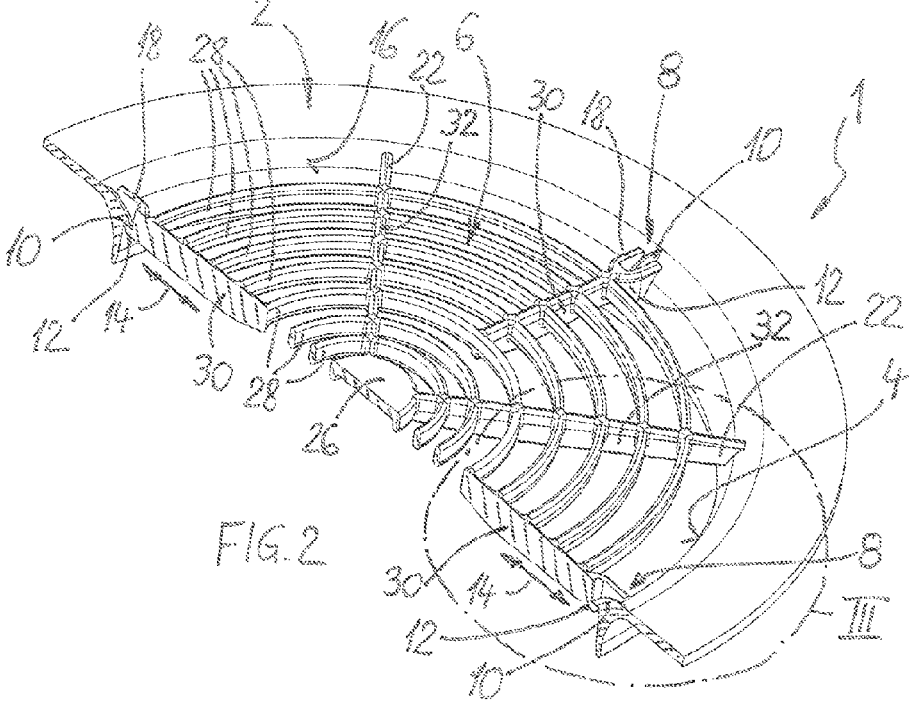
Figure 3:
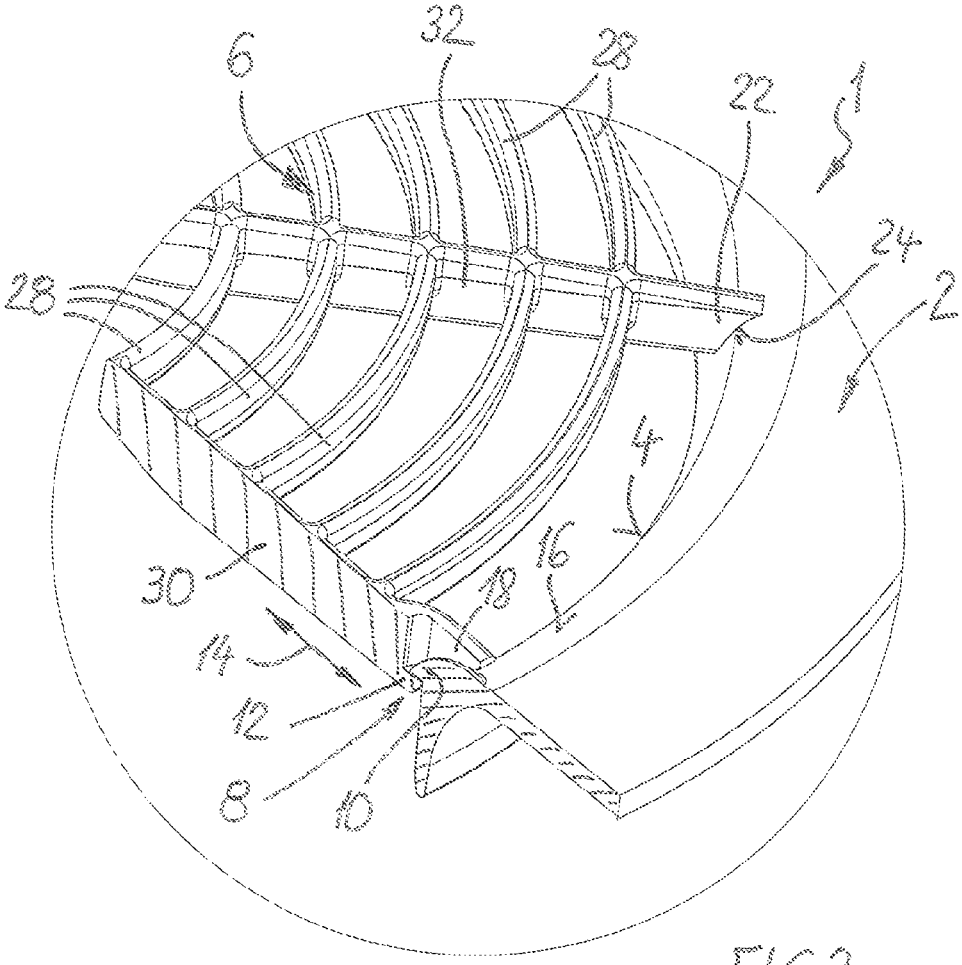
Figure 4:
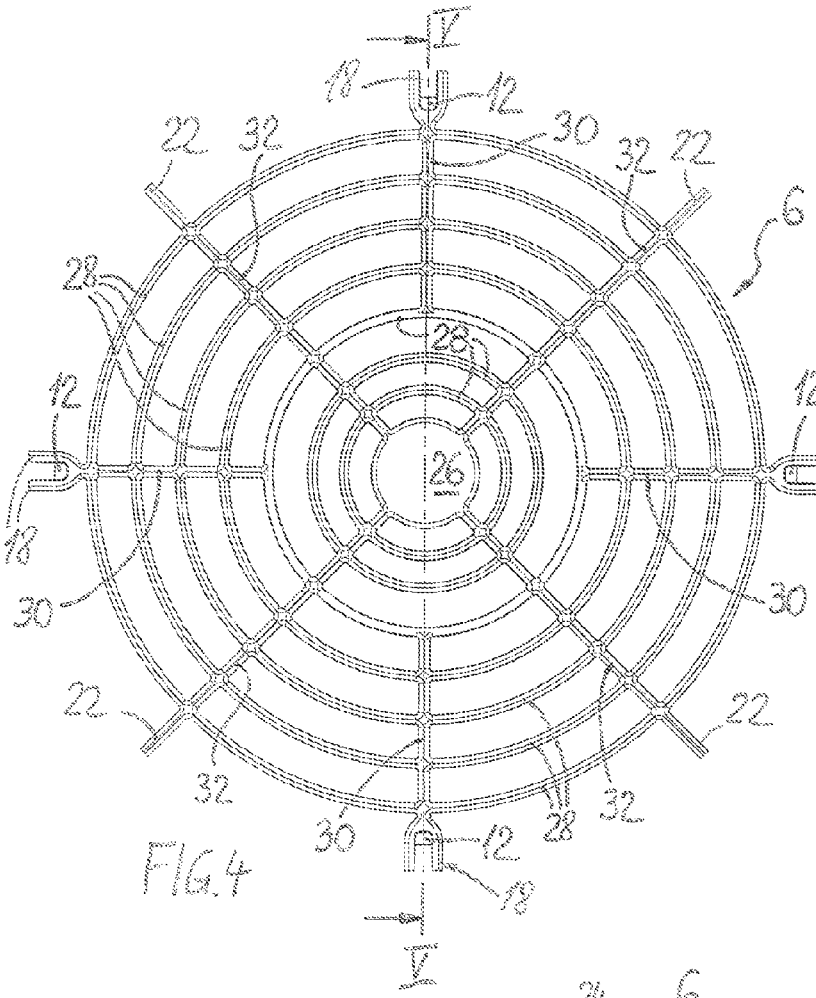
Figure 5:
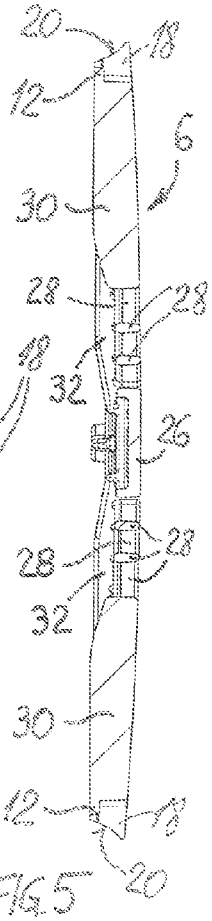
Figure 6:
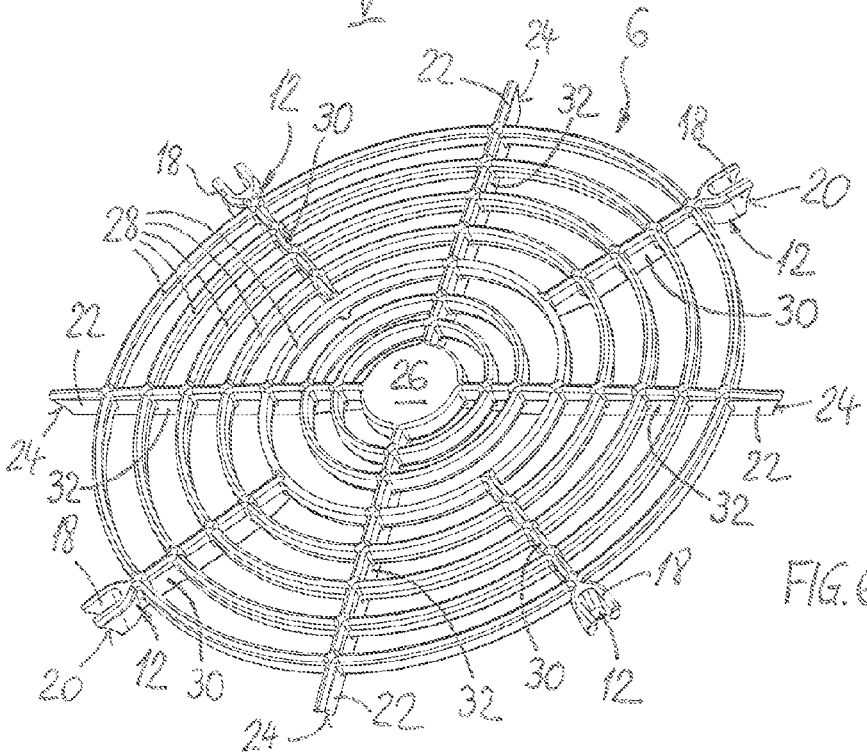

As is first apparent from FIGS. 1 to 3, a protective screen assembly 1 according to the invention comprises a cover part 2 having in particular a circular air passage opening 4. The cover part 2 is arranged upstream of a rotating fan wheel, which is not shown, wherein the passage opening 4 forms an air inlet for the air taken in by the fan wheel. Alternatively, the cover part 2 can, of course, be arranged downstream of a fan wheel, wherein the passage opening 4 would then form a blow-out opening. The fan wheel, which is not shown, can be configured as an axial fan, radial fan, or also as a diagonal fan.

In order to close the passage opening 4 for safety reasons as protection against accidental contact with the rotating fan wheel, a protective screen 6 can be attached to the cover part 2 in the area of the passage opening 4. For this purpose, a plurality of, and more particularly at least three, detent connections 8 are distributed over the circumference. Each of these detent connections 6 comprises a detent shoulder 10 rigidly arranged in the area of the passage opening 4 and a detent element 12 arranged on the protective screen 6.

According to the invention, the detent elements 12 do not project axially from the protective screen 6, but are arranged practically at the outer edge of the protective screen 6 in the screen plane thereof. The term "screen plane" does not, however, mean that the entire protective screen 6 must be exactly located in one plane; the protective screen 6 can rather, in the overall, have a slightly convexly outwardly curved lattice shape. In general, the detent elements 12 are arranged pointing substantially radially outward from the outer edge of the protective screen 6. According to the invention, the protective screen 6 can moreover be designed to be resiliently deformable in the area of each detent element 12 such that, for the purpose of engaging or disengaging the detent connection 8, each detent element 12 can be moved radially relative to the related detent shoulder 10 with regional elastic deformation of the protective screen 6, but without the detent element itself being elastically deformed. This radial movement is shown in FIGS. 2 and 3 by a double arrow 14.

The preferably circular passage opening 4 of the cover part 2 is preferably configured with an opening edge 16 which tapers in a nozzle-like manner from an outer side toward an inner side facing the fan wheel. This opening edge 16 in particular has a convexly curved surface in the longitudinal section. Alternatively, it could also be a conical inclined surface. In this case, the detent shoulders 10 are arranged in the tapering area of the opening edge 16. As a result of this, the protective screen 6 can be supported not only radially, but also axially on the opening edge 16.

For this purpose, each detent element 12 has a bifurcated end section 18 projecting radially outward, which encloses the related detent shoulder 10 of the cover part 2 in the circumferential direction on both sides. The protective screen 6 is thus protected against turning around the opening axis. In the free end area of the bifurcated end section 18, each detent element 12 has a contact contour 20 that is adapted to the surface contour of the opening edge 16 of the passage opening 4 such that the end section 18 can be supported radially and axially on the opening edge 16 via the contact contour 20.

In addition, a radial support section 22 is arranged in each case between two adjacent detent elements 12 for the play-free support of the protective screen 6 in the circumferential direction, wherein each support section 22 has an end-side contact contour 24 for the radial and axial contact with on the opening edge 16 of the passage opening 4. The support sections 22 are preferably arranged relative to the detent elements 12 such that, in the snapped-in state of the protective screen 6, the support sections 22 rest axially and radially without play on the opening edge 16 with an elastic contact force. This contact force is generated by the minor regional deformation (axial deflection) of the protective screen 6. No additional projecting elements are advantageously provided for the contact of the support sections 22 in the area of the opening edge 16; rather the opening edge 16 is configured with a flat surface in these areas for the direct contact of the support sections 22 and is thus flow-optimized for applications of the cover part 2 without the protective screen 6.

In another advantageous embodiment, by way of adaptation to the circular passage opening 4, the protective screen 6 comprises a centric, in particular disk-shaped, center part 26 and a plurality of concentric, circular or circular ring-shaped protective struts 28, which are each spaced mutually apart by radial safety distances. As an alternative to the disk-shaped center part 26, this can also have a ring-shaped configuration. In the area of each detent element 12, the protective screen 6 has a radially inwardly extending detent strut 30, which ends at one of the protective struts 28 radially spaced apart from the center part 26. Accordingly, each detent strut 30 does not extend up to the center part 26, so that a radial deformation of the protective strut(s) connected to and/or via the detent strut 30 is possible by means of a certain radial force. In this case—in addition to the material and/or shape-dependent elasticity of the individual protective struts 28 of the protective screen 6—the amount of the required radial force also depends on the number of the protective struts 28 connected to the respective detent strut 30. In the shown, preferred exemplary embodiment, each detent element 12 is connected to five supporting struts 28 via the detent strut 30 so that the radial spring force is generated by all five protective struts 28 together on deformation. The amount of radial spring force can thus be predetermined by the number of the protective struts 28 involved in the elastic deformation.

It should further be mentioned that each detent element 12 and the related detent shoulder 10 interact when they are joined via inclined surfaces, which are not shown, such that, on engaging, an axial joining movement automatically effects an elastic radial movement of each detent element 12, regionally deforming the protective screen 6. In the snap-fit state, positive fit in the axial direction is then achieved because a so-called undercut angle between the detent surfaces of the detent shoulder 10 and the detent element 12 is greater than/equal to 90°.

In another preferred embodiment, each support section 22 is formed by a free, radially projecting end of a carrier strut 32 of the protective screen 6 that continuously extends radially inward to the center part 26. In this way, high radial stability of the protective screen 6 is achieved, more specifically in the case of an even number of support sections 22 and carrier struts 32 with a radially symmetrical distribution, because then two carrier struts 32 are respectively located diametrically opposed of each other on a common diameter line so that almost no elastic deformation in the radial direction is possible in the direction of this diameter line.

It is advantageous to configure the protective screen 6 as an integrally molded plastic part. Alternatively, the protective screen 6 can, however, also be made at least partially of metal, in particular of a metal wire.

The cover part 2 is also preferably formed as a plastic molded part, wherein the detent shoulders 10 are integrally formed. In this case, as is apparent from FIGS. 1 to 3, the cover part 2 can, in the overall, be configured in a ring shape with a likewise circular outer contour (for example, as a so-called "wall ring") or as a housing/wall part with any arbitrary, for example rectangular or square, outer contour with optionally rounded or chamfered edges (for example as a "front plate").

The protective screen 6 has at least three, in particular, as shown, four, detent elements 12 which are distributed in a radially symmetrical manner over the circumference. This also applies accordingly to the number and arrangement of the detent struts 30, the support sections 22 and the carrier struts 32.

The number of the circular and/or circular ring-shaped protective struts 28 depends on the size of the passage opening 4 to be covered and on the maximum safety distances between the adjacent protective struts 28. In the shown example, seven protective struts 28 are provided concentrically around the center part 26, wherein each detent element 12 is connected to the five outer protective struts 28 via the associated detent strut 30. Notwithstanding this preferred embodiment, arbitrary other designs are, however, also possible.

The foregoing description of various embodiments of the invention has been presented for purposes of illustration and description. It is not intended to be exhaustive or to limit the invention to the precise embodiments disclosed. Numerous modifications or variations are possible in light of the above teachings. Furthermore, characteristics of one embodiment may be combined with characteristics of another embodiment within the scope of the invention. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A protective screen assembly for a fan, comprising:

a cover part having a passage opening for an air flow; the passage opening having a circular shape;

a protective screen configured to be connected in an area of the passage opening to the cover part, the protective screen having a disk-shaped center part and a plurality of concentric, circular protective struts;

a plurality of circumferentially distributed detent connections so as to close the passage opening as protection against contact with fan blades, each detent connection comprising a detent shoulder that is rigidly arranged on the cover part in the passage and an associated detent element arranged at an outer edge of the protective screen and arranged substantially in a radial plane aligned with the protective screen; and the protective screen being configured in a resiliently deformable manner in the area of each detent element such that, for the purpose of engaging and disengaging the detent connection, each detent element can be moved radially relative to the associated detent shoulder by regionally elastically deforming the protective screen; and in the area of each detent element, the protective screen having a detent radial strut extending inward and ending at a radial distance from the center part at one of the protective struts radially spaced apart from the center part.

2. The protective screen assembly according to claim 1, further comprising that the passage opening of the cover part has an opening edge with a contour that tapers in a nozzle-like manner from an outer side toward an inner side.

3. The protective screen assembly according to claim 2, further comprising that each detent element has a free end area with a contact contour that is adapted to the contour of the opening edge of the passage opening of the cover part.

4. The protective screen assembly according to claim 2, further comprising that, between two respective adjacent detent elements, the protective screen includes a radial support section having a radially outward end with a contact contour for radial and axial contact with the opening edge of the passage opening of the cover part.

5. The protective screen assembly according to claim 4, further comprising that the support section rests axially and radially without play on the opening edge with an elastic contact force in a snapped-in state of the protective screen.

6. The protective screen assembly according to claim 4, further comprising that each support section is formed by a radially protruding end of a carrier strut that continuously extends radially inward to a center part of the protective screen.

7. The protective screen assembly according to claim 1, further comprising that each detent element of the protective screen has a radially outwardly projecting, bifurcated end section, which surrounds the associated detent shoulder of the cover part on opposite sides in a circumferential direction.

8. The protective screen assembly according to claim 1, further comprising that each detent connection has inclined cooperating detent surfaces, configured to cause an elastic radially inward movement of the detent element upon an axial joining movement between the detent element and the associated detent shoulder, and that the detent element engages with the detent shoulder by a radially outward movement into an axial positive fit between the detent element and the associated detent shoulder.

9. The protective screen assembly according to claim 1, further comprising that the protective screen is an integrally molded plastic part.

10. The protective screen assembly according to claim 1, further comprising that the protective screen is at least partially made of metal wire.

11. The protective screen assembly according to claim 1, further comprising that the protective screen has at least three detent elements evenly circumferentially distributed over the outer edge.

* * * * *